US007552676B1

(12) United States Patent
Johnson

(10) Patent No.: US 7,552,676 B1
(45) Date of Patent: Jun. 30, 2009

(54) POWER OPERATED CONTAINER CRUSHING DEVICE

(76) Inventor: Kenneth L. Johnson, 1311 N. Griffith Park Dr., Burbank, CA (US) 91506

( * ) Notice: Subject to any disclaimer, the term of this patent is extended or adjusted under 35 U.S.C. 154(b) by 0 days.

(21) Appl. No.: 11/950,427

(22) Filed: Dec. 5, 2007

(51) Int. Cl.
*B30B 1/18* (2006.01)
*B30B 9/32* (2006.01)

(52) U.S. Cl. ..... 100/289; 100/52; 100/345; 100/215; 100/226; 100/245; 100/902

(58) Field of Classification Search ..... 100/43, 100/48, 49, 50, 51, 52, 345, 214, 215, 226, 100/240, 245, 280, 288, 289, 902
See application file for complete search history.

(56) References Cited

U.S. PATENT DOCUMENTS 708,863 A * 9/1902 Bussinger ..... 100/289
2,790,478 A * 4/1957 Shapiro ..... 269/243
4,970,951 A * 11/1990 Katz ..... 100/289
5,967,029 A * 10/1999 Mayo ..... 100/99
6,923,114 B2 * 8/2005 Koch ..... 100/98 R

* cited by examiner

*Primary Examiner*—Jimmy T Nguyen
(74) *Attorney, Agent, or Firm*—James A. Italia, Esq.; Italia IP

(57) ABSTRACT

A power operated container crushing device, the device comprising: an upper housing; a lower housing integral with the upper housing; and a crushing mechanism comprising a motor attached to and retained in upper housing, wherein said motor includes a motor hear for rotational engagement with a drive gear; a drive axle with the drive gear fixably attached at one end for rotation thereof and means to attach the drive axle to a threaded sleeve at the other; an elongated threaded sleeve fixably attached to the drive axle for rotation thereof; a threaded shaft for threadably engaging the threaded sleeve; and a crushing plate fixably attached to the threaded shaft; wherein when the motor rotates the motor gear in one direction, the crushing plate moves in a downward direction, and when the motor rotates in the opposite direction, the crushing plate moves in an upward direction.

13 Claims, 9 Drawing Sheets

POWER OPERATED CONTAINER CRUSHING DEVICE

BACKGROUND OF INVENTION

This application relates generally to can crushing devices. More specifically, this application relates to a power operated container crushing device that allows a user to crush various containers such as soda and beer cans, and plastic bottles efficiently and effectively.

SUMMARY

Recycling has become a vital part of life for a large percentage of the population. The environmental benefits of recycling aluminum cans and plastic bottles are well accepted. One disadvantage of recycling is the large amount of space that such items take up in their uncrushed state. Described herein is a power operated container crushing device that is easy to use and solves the storage problem mentioned above. The device is of simple construction, inexpensive to produce, and can be used anywhere it is desirable to have a convenient crushing device.

In particular, this application discloses a power operated container crushing device, the device comprising: an upper housing, wherein said upper housing includes means for retaining a crushing mechanism, means to power said crushing mechanism, and a switching mechanism functionally linked to said crushing mechanism; a lower housing integral with said upper housing, wherein said lower housing includes a first opening for inserting the container therethrough and a door hingedly attached thereto for gaining or preventing access to said lower housing from said first opening; a crushing mechanism comprising a motor attached to and retained in said upper housing, wherein said motor includes a motor gear for rotational engagement with a drive gear; a drive axle with said drive gear fixably attached at one end for rotation thereof and means to attach said drive axle to a threaded sleeve at the other; an elongated threaded sleeve fixably attached to said drive axle for rotation thereof; a threaded shaft for threadably engaging said threaded sleeve; and a crushing plate fixably attached to said threaded shaft; wherein when said motor rotates said motor gear in one direction, said crushing plate moves in a downward direction into said lower housing thereby crushing any container inserted therein, and when said motor rotates in the opposite direction, said crushing plate moves in an upward direction.

This application also discloses a power operated container crushing device, the device comprising: an upper housing, wherein said upper housing includes means for retaining a crushing mechanism, means to power said crushing mechanism, and a switching mechanism functionally linked to said crushing mechanism; a lower housing integral with said upper housing, wherein said lower housing includes a first opening for inserting the container therethrough and a door hingedly attached thereto for gaining or preventing access to said lower housing from said first opening, wherein said door includes a latch mechanism for closing said door and denting means for predenting said container when said door is latched; a crushing mechanism comprising a motor attached to and retained in said upper housing, wherein said motor includes a motor gear for rotational engagement with a drive gear; a drive axle with said drive gear fixably attached at one end for rotation thereof and means to attach said drive axle to a threaded sleeve at the other; an elongated threaded sleeve fixably attached to said drive axle for rotation thereof; a threaded shaft for threadably engaging said threaded sleeve; and a crushing plate fixably attached to said threaded shaft; wherein when said motor rotates said motor gear in one direction, said crushing plate moves in a downward direction into said lower housing thereby crushing any container inserted therein, and when said motor rotates in the opposite direction, said crushing plate moves in an upward direction; wherein the crushing mechanism further comprises reversing means electronically coupled to said crushing mechanism for reversing the crushing plate from a downward direction to an upward direction.

This application further discloses a power operated container crushing device, the device comprising: an upper housing, wherein said upper housing includes means for retaining a crushing mechanism, means to power said crushing mechanism, and a switching mechanism functionally linked to said crushing mechanism; a lower housing integral with said upper housing, wherein said lower housing includes a first opening for inserting the container therethrough and a door hingedly attached thereto for gaining or preventing access to said lower housing from said first opening, wherein said door includes a latch mechanism for closing said door and denting means for predenting said container when said door is latched, and whereby said switching mechanism is inoperable if said door is not fully latched; a crushing mechanism comprising a motor attached to and retained in said upper housing, wherein said motor includes a motor gear for rotational engagement with a drive gear; a drive axle with said drive gear fixably attached at one end for rotation thereof and means to attach said drive axle to a threaded sleeve at the other; an elongated threaded sleeve fixably attached to said drive axle for rotation thereof; a threaded shaft for threadably engaging said threaded sleeve; and a crushing plate fixably attached to said threaded shaft; wherein when said motor rotates said motor gear in one direction, said crushing plate moves in a downward direction into said lower housing thereby crushing any container inserted therein, and when said motor rotates in the opposite direction, said crushing plate moves in an upward direction; wherein the crushing mechanism further comprises reversing means electronically coupled to said crushing mechanism for reversing the crushing plate from a downward direction to an upward direction; wherein said lower housing further comprises a second opening to allow a crushed container to pass through and exit from the lower housing.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
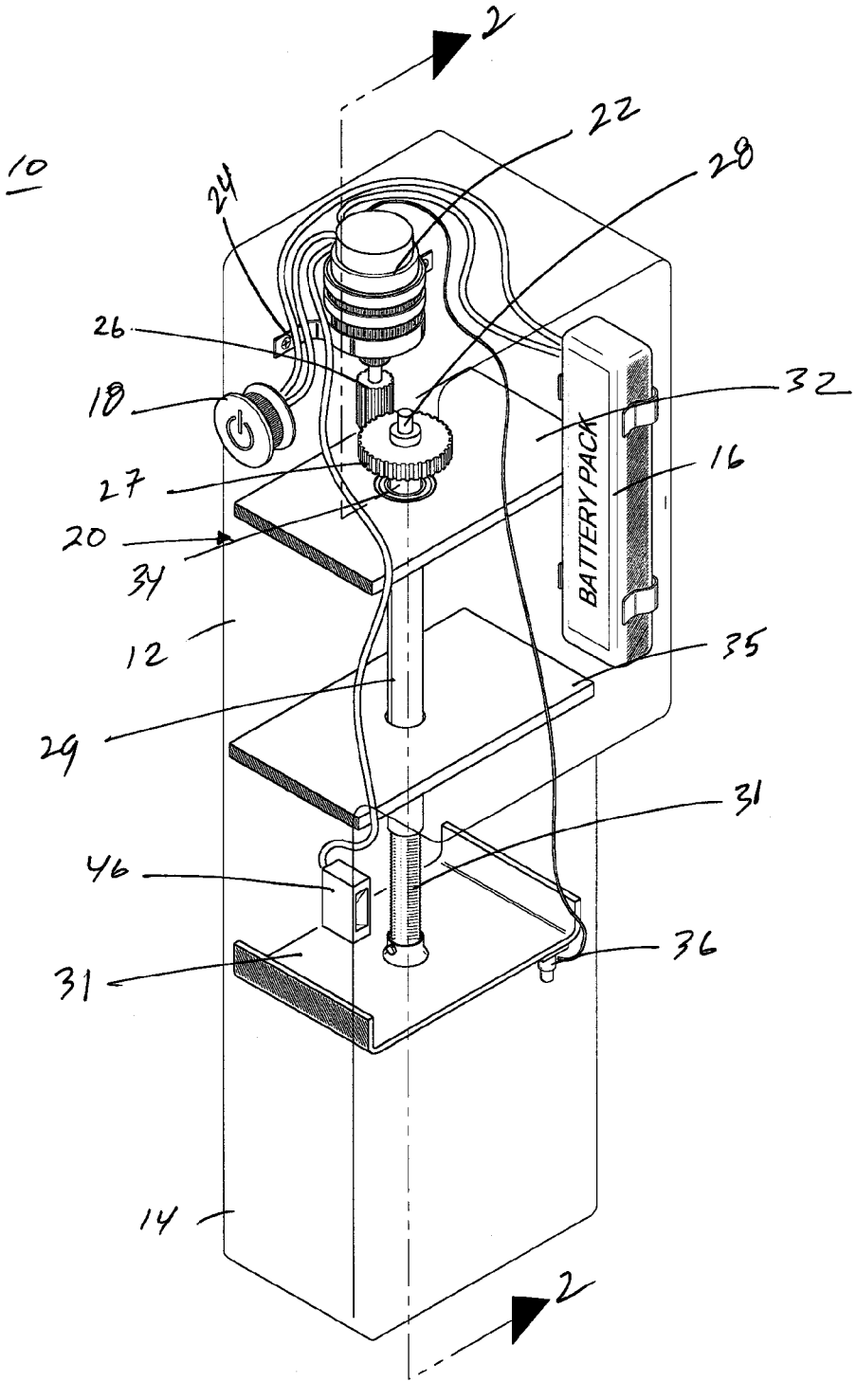
FIG. 1 is a perspective view of a first embodiment of the powered container crushing device disclosed herein, shown with a transparent housing to better show the internal features.
Figure 2A:
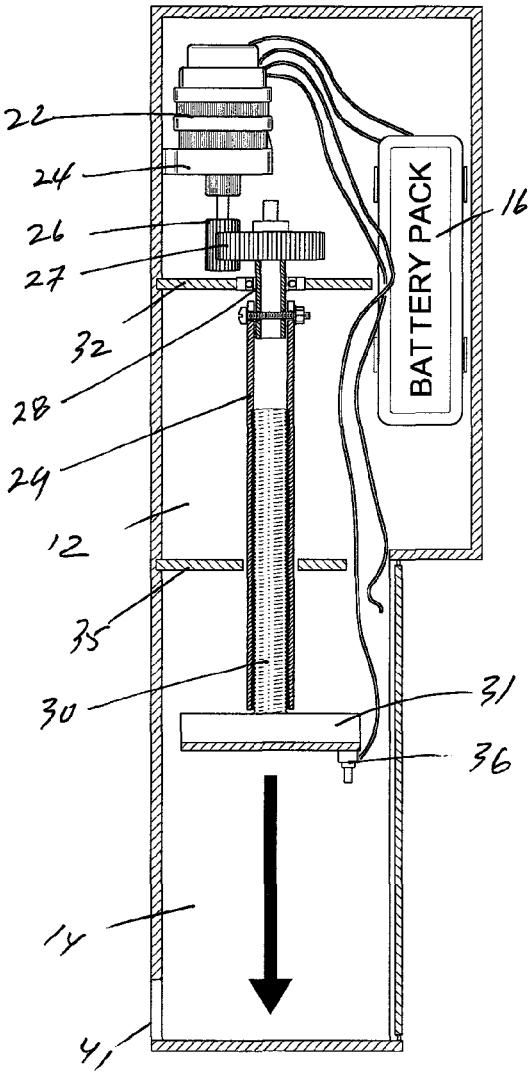
FIGS. 2A-2C is a cross-sectional view of the device in FIG. 1 along the line 2-2, showing the process of crushing an aluminum can.
Figure 2B:
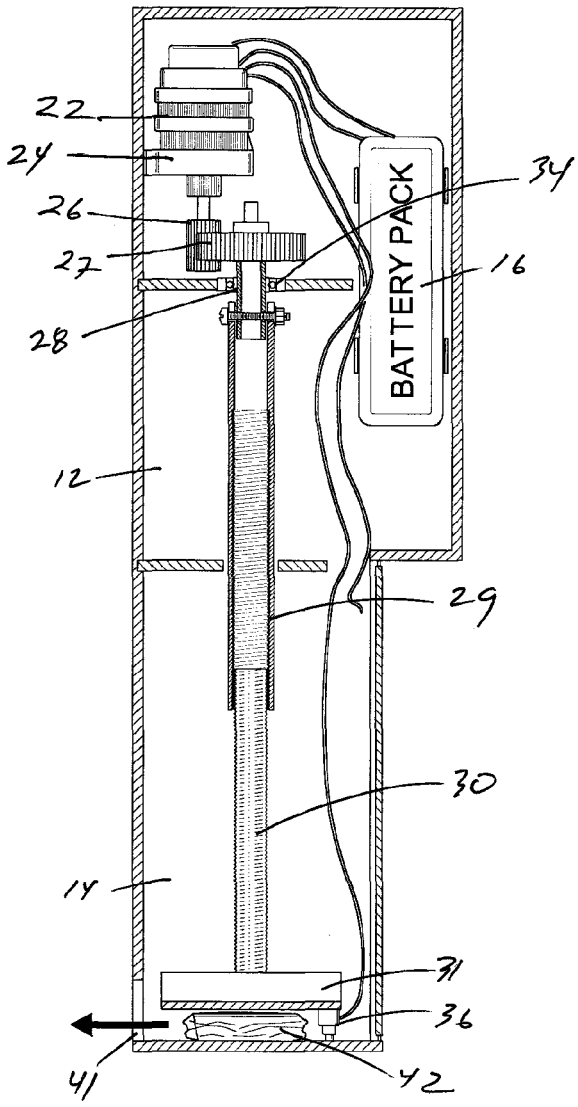
Figure 2C:
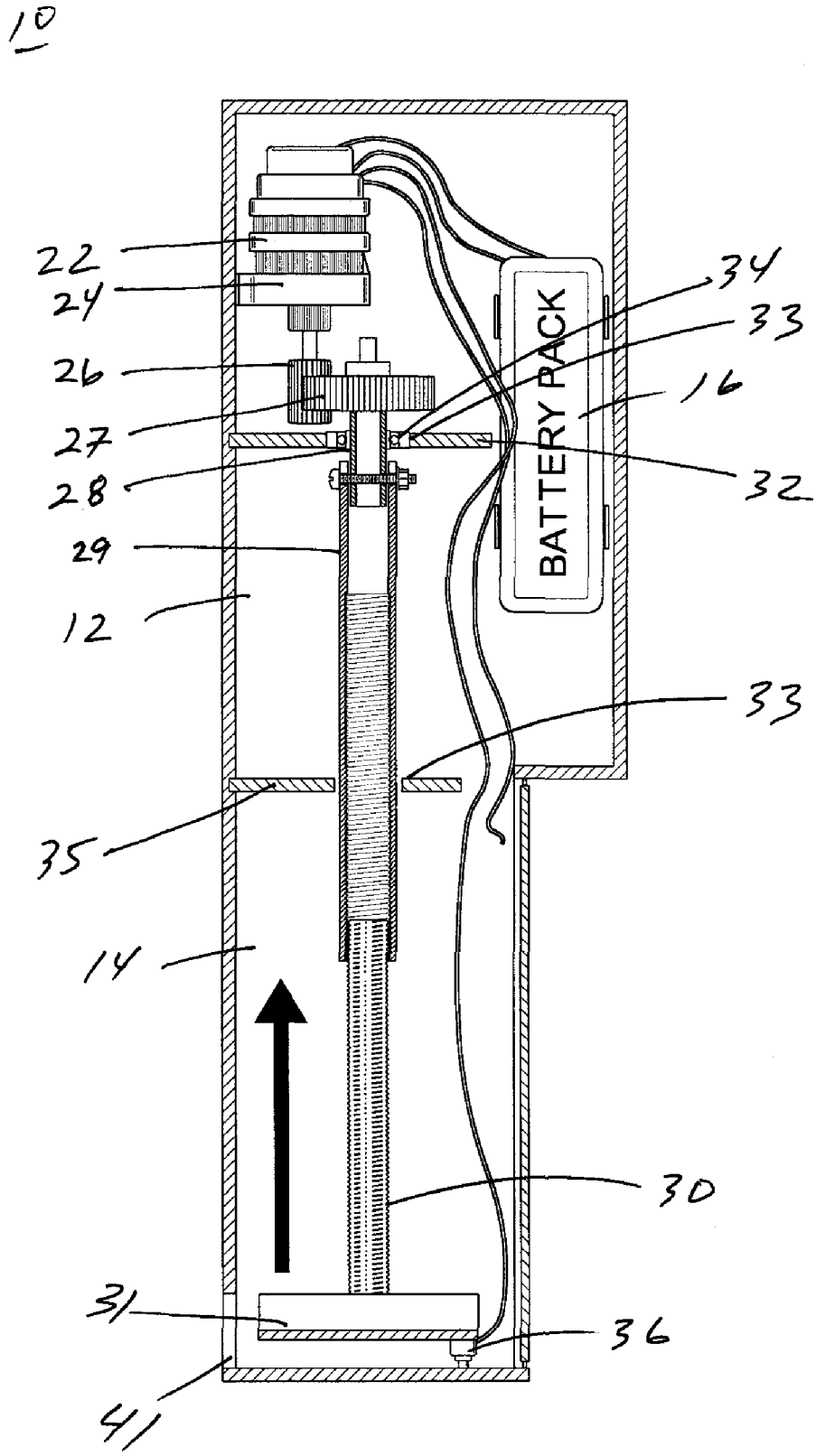
Figure 3A:
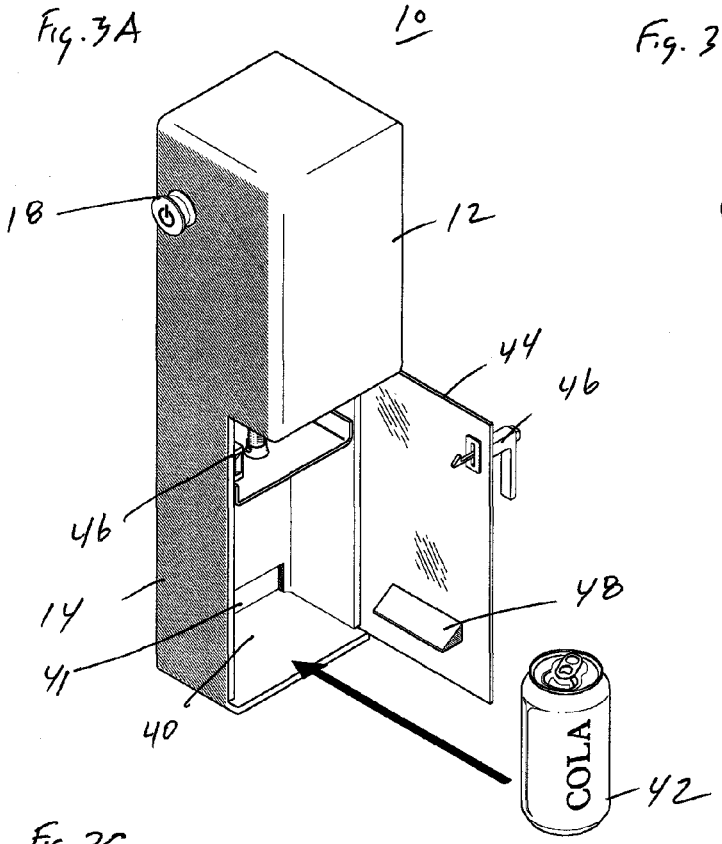
FIGS. 3A-3D is a perspective view of the device in FIG. 1 showing the process of crushing an aluminum can.
Figure 3B:
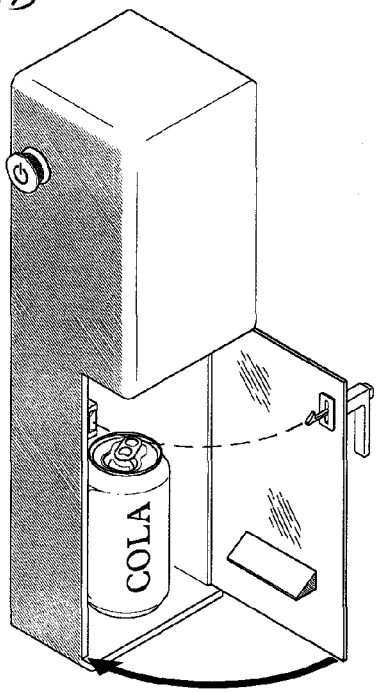
Figure 3C:
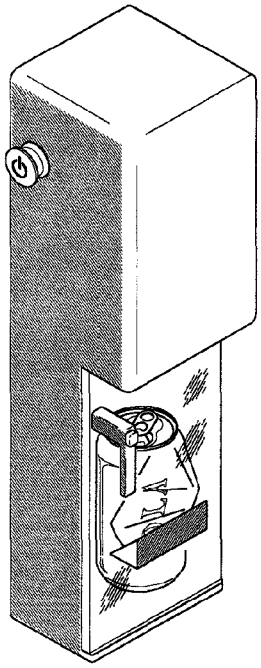
Figure 3D:
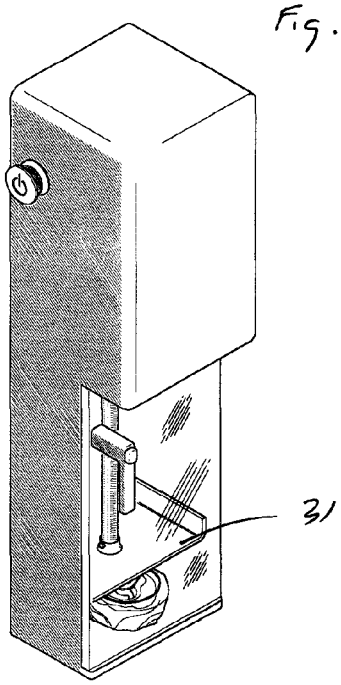
Figure 4A:
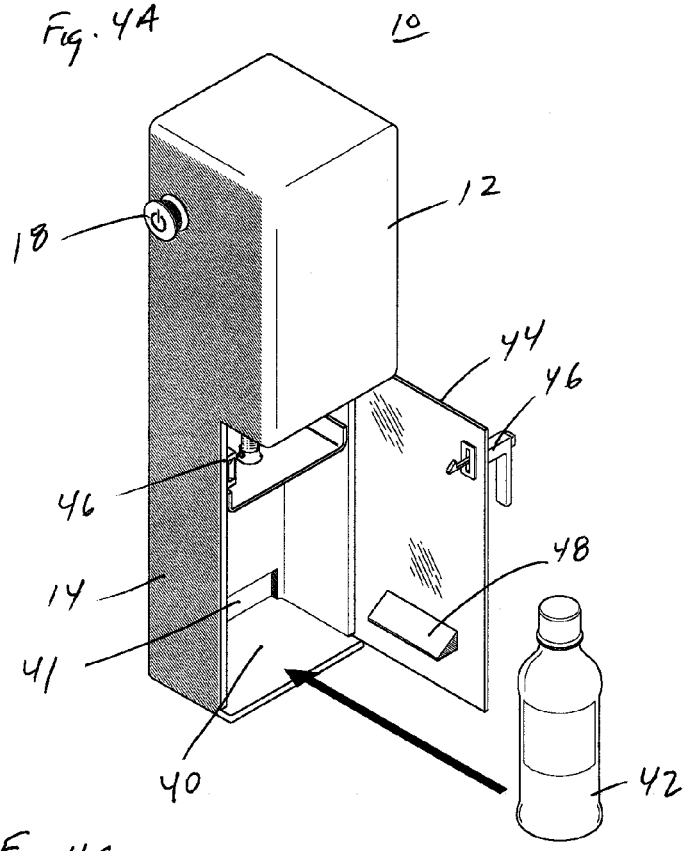
FIGS. 4A-4D is a perspective view of the device in FIG. 1 showing the process of crushing a plastic bottle.
Figure 4B:
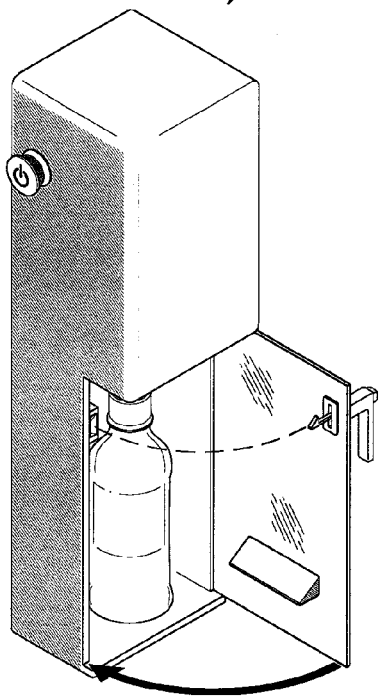
Figure 4C:
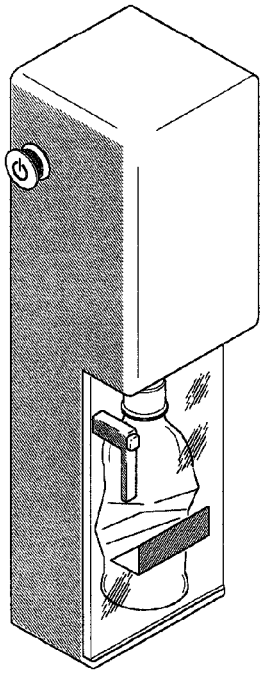
Figure 4D:
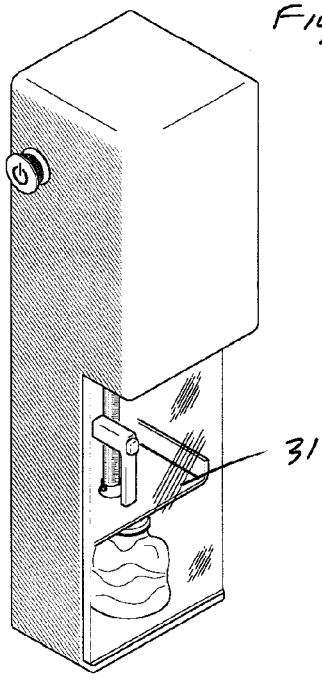
Figure 5:
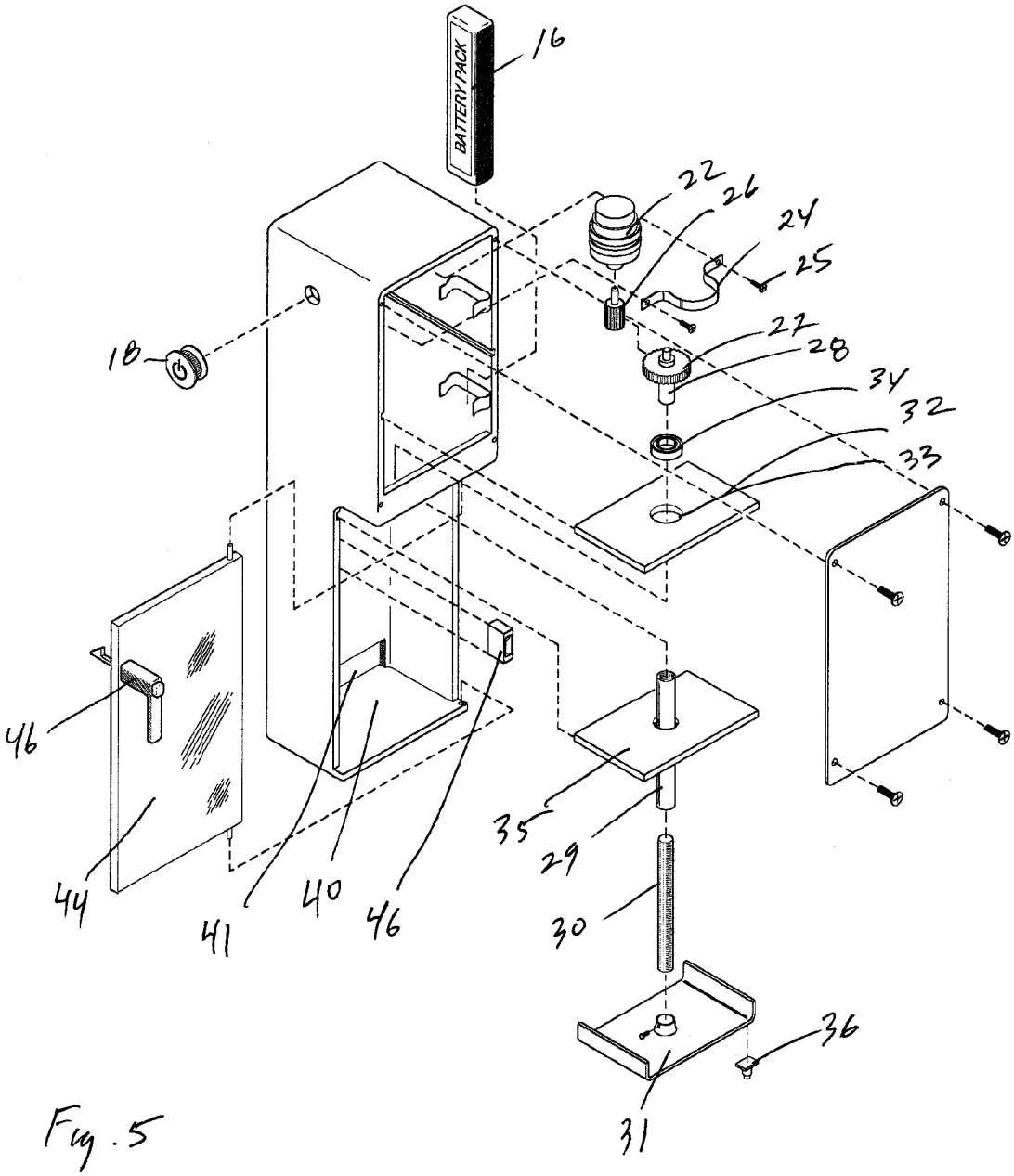
FIG. 5 is an exploded view of the device in FIG. 1.

Referring to FIGS. 1-2C and 5, shown therein and generally designated by the reference character 10 is a power operated container crushing device constructed in accordance with the following description. The device 10 includes an upper housing 12 and a lower housing 14. The upper housing 12 includes a crushing mechanism 20, a power source 16 to power the crushing mechanism, and a switching mechanism 18 functionally linked by electrical communication to the crushing mechanism 20 and the power source 16 for activating the crushing mechanism. As shown, the power source 16 is a rechargeable battery, however it is contemplated that the power source 16 could be a non-rechargeable battery, or the device could be plugged into a DC or AC power source.

Referring now to FIGS. 3A-3D, lower housing 14 is integral with the upper housing 12, and includes a first opening 40 for inserting the container 42 therethrough, in this case an aluminum can. See FIGS. 4A-4D, where the container 42 is a plastic bottle. But the operation is the same. The lower housing 12 may also include a second opening 41 to allow a crushed container 42 to pass through and exit from the lower housing 14. The second opening 41 is particularly effective when the device is placed in a horizontal position so that when a container 42 is crushed, it is now small enough to fall through the second opening and preferably into a recycling bin just below. See FIG. 8. A door 44 is hingedly attached thereto for gaining or preventing access to the lower housing 14 from the first opening 40. The door 44 may include a latch mechanism 46 for closing the door 44 and denting means for predenting the container 42 when the door 44 is latched. As shown, the denting means is a wedge shaped portion 48 integral with the door 44, which acts to slightly dent the container 42 when the door 44 is latched thereby weakening the container 42 and making it more easily crushable by the crushing mechanism 20. It should be appreciated that any type of shape that predents the container 42 would be equally effective. Further, the denting means could be on the wall opposite the door 44 and still be effective. In a particular embodiment, the switching mechanism 18 electronically linked to the latch mechanism 46 such that the switching mechanism is inoperable if the door 44 is not fully latched and/or the crushing mechanism 20 is deactivated if the door 44 is unlatched and opened during operation.

Referring again to FIGS. 1-2C and 5, the crushing mechanism 20 includes a motor 22 attached to and retained in the upper housing 12 by a bracket 24 and screws 25. The motor 22 includes a motor gear 26 for rotational engagement with a drive gear 27. The drive gear 27 is fixably attached to one end of a drive axle 28. The other end of the drive 28 axle includes means to attach the drive axle 28 to a threaded sleeve 29. As shown, the means to attach the drive axle 28 to the threaded sleeve 29 is a bore and screw assembly as is common in the art. Next, a threaded shaft 30 is threadably engaged to the threaded sleeve 29. Fixably attached using a screw and bore assembly to the lower end of the threaded shaft 30 is crushing plate 31. The crushing plate 31 is shaped to substantially fit the interior space of the lower housing 14, such that it is prevented from rotating within the lower housing. Thus, in contemplating the above described structure of the crushing mechanism 20, when the motor 22 rotates the motor gear 26 in one direction, the crushing plate 31 moves in a downward direction into the lower housing 14 thereby crushing any container 42 inserted therein, and conversely, when the motor 22 rotates in the opposite direction, the crushing plate 31 moves in an upward direction. See below for more details regarding the operation of the device 10.

Additionally, the device 10 may include a first support plate 32 integral the upper housing 12, whereby the plate includes a bore 33 for said drive axle 28 to pass through. As shown, a bearing 34 is inserted into the bore 33 for rotational abutment to the drive axle 28. Further, a second support plate 35 is also shown integral with the lower portion of the upper housing 12, and includes a bore 33 for the threaded sleeve 29 to pass through. The first 32 and second 35 support plates provide the crushing mechanism 20 stability and help guide the crushing plate 31 in a vertical direction during operation.

Figure 6:
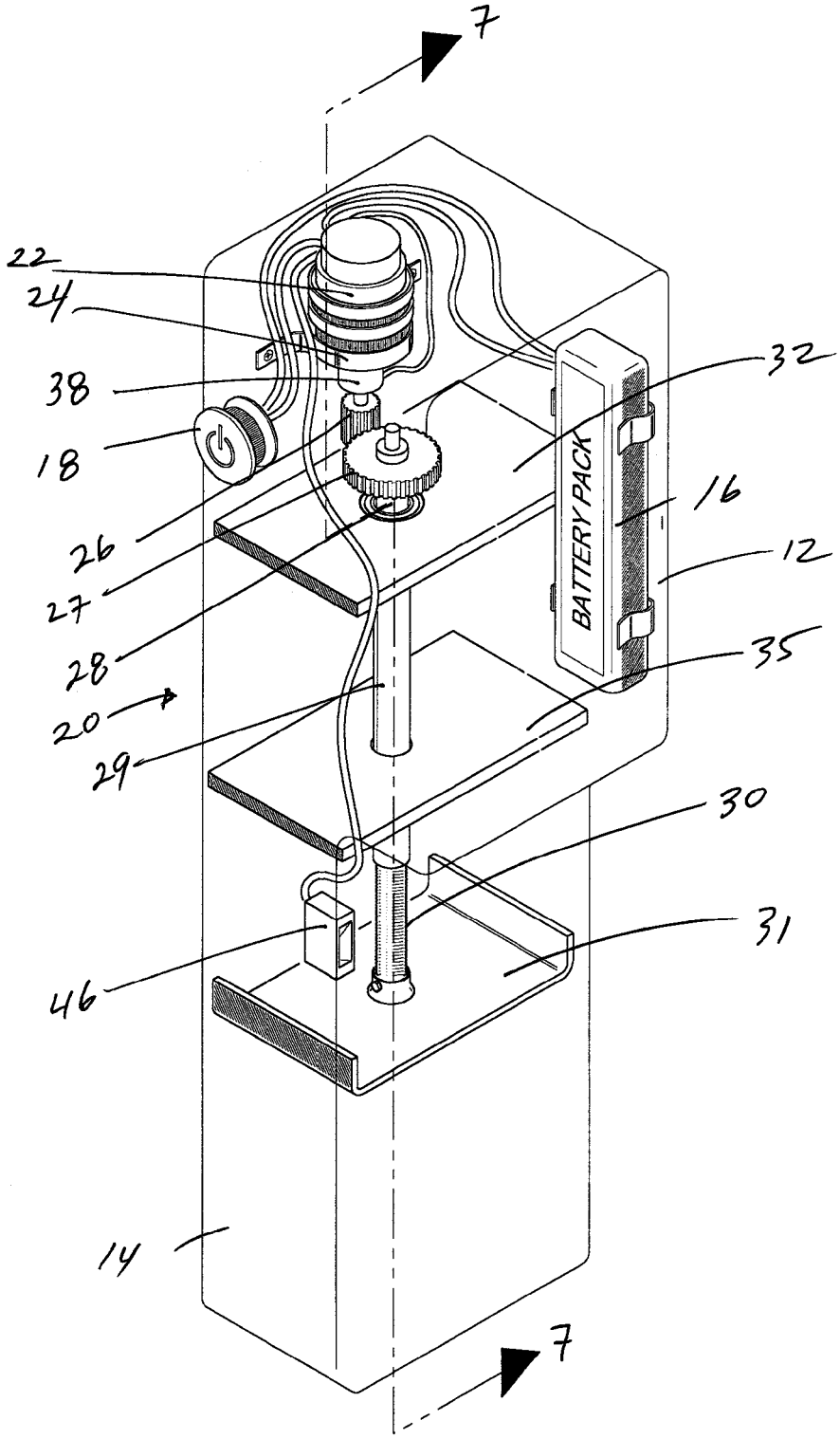
FIG. 6 is a perspective view of a second embodiment of the powered container crushing device disclosed herein, shown with a transparent housing to better show the internal features.
Figure 7:
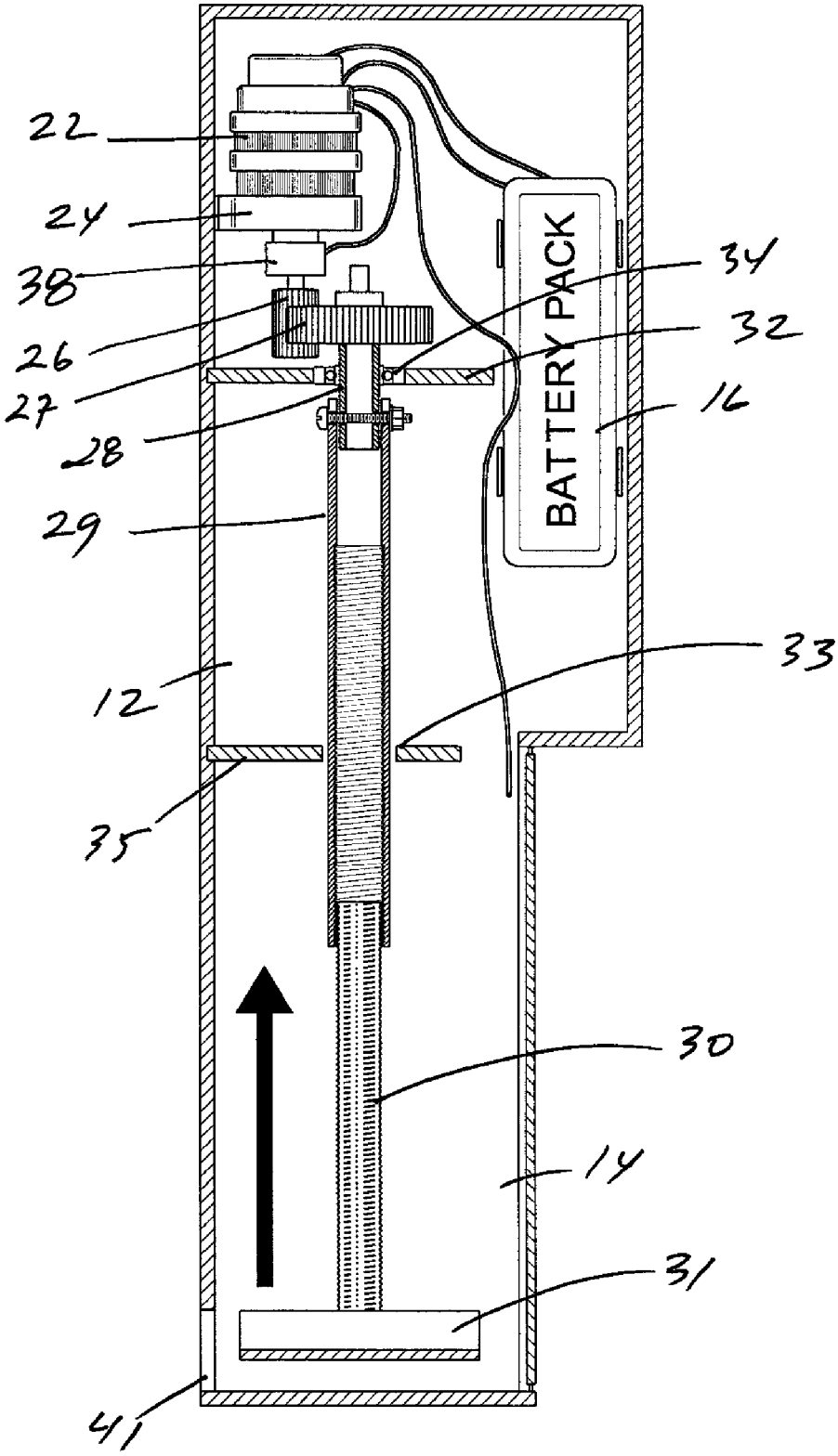
FIG. 7 is a cross-sectional view of the device in FIG. 6 along the line 7-7, shown following crushing a container; and, FIG. 8 is a perspective view of the powered container crushing device disclosed herein, shown in a representative environment.

The device 10 may also include reversing means electronically coupled to the crushing mechanism 20 for reversing the crushing plate 31 from a downward direction to an upward direction. Referring again to FIGS. 1-2C and 5, a first embodiment of the reversing means is shown. In this embodiment a pressure switch 36 is located on the crushing plate such that when the crushing plate extends to its lowest position (FIG. 2B), the switch 36 is activated by coming in contact with the base 37 of the lower housing thereby reversing the motor 22 and the direction of the crushing plate 31. Referring now to FIGS. 6 and 7, a second embodiment of the reversing means is shown. In this embodiment the reversing means is a torque sensor 38 such that when a determined maximum torque is reached during the crushing of a container 42, the maximum torque is sensed by the sensor 38 thereby reversing the motor 22 and the direction of the crushing plate 31. Additional reversing means are also contemplated, for example: (1) the crushing mechanism 20 may reach its lowest point and pause for a determined amount of time before returning, and (2) the switching mechanism 18 can be used to control the direction of the motor 22 and respective crushing plate 31.

Figure 8:
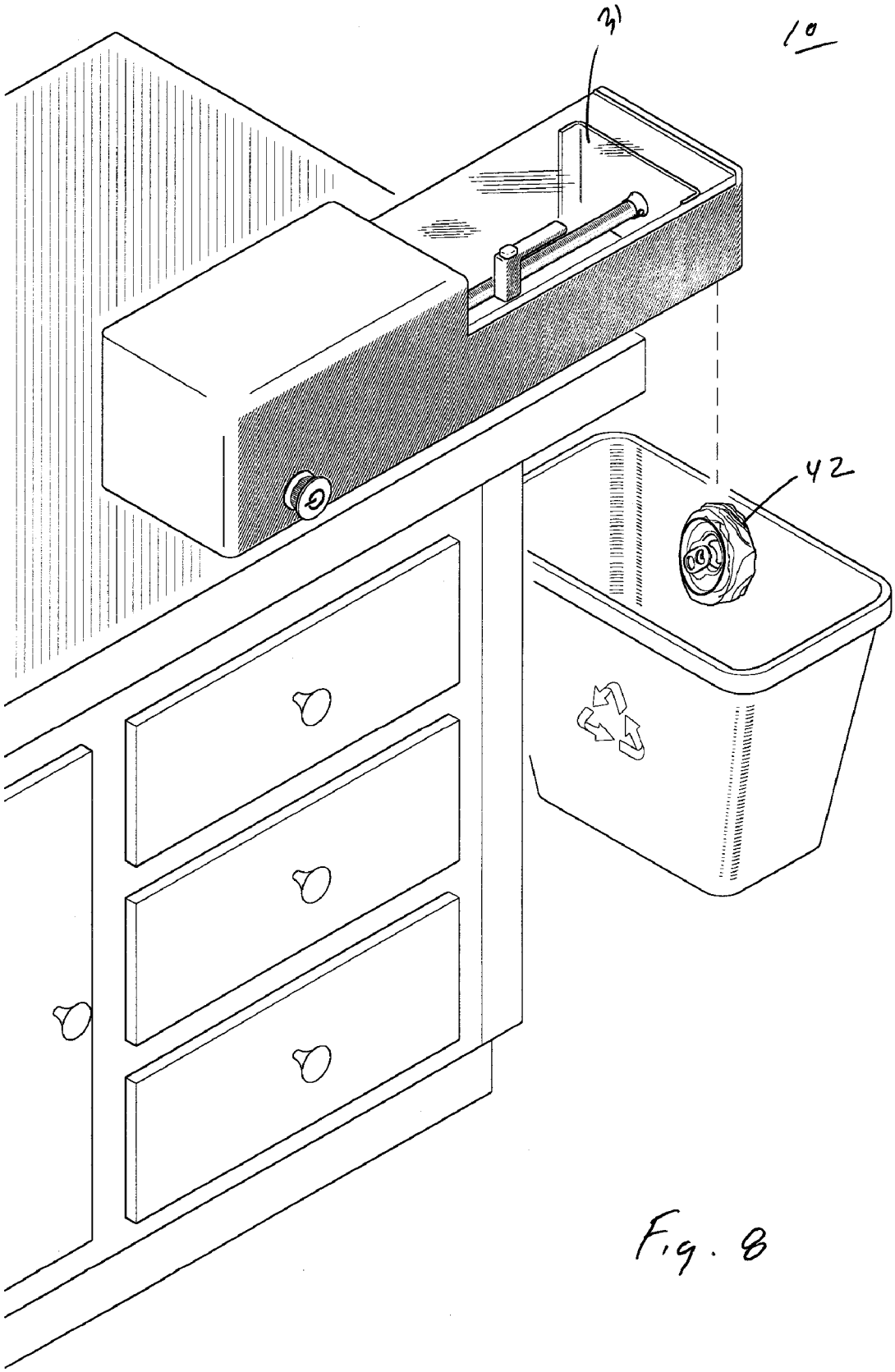

Referring to FIGS. 3A-4D, The basic operation of the device 10 is the following, a user opens the door 44 and inserts a container 42 into the first opening 40. The door is closed/latched which acts to both predent the container 42 and allows for the switching mechanism 18 to be operable. The user than depresses the switching mechanism 18 which activates the crushing mechanism 20 and causes the motor 22 to rotate the motor gear 26, which in turn causes the drive gear 27 and the drive axle 28 to rotate. This in turn causes the fixably attached threaded sleeve 29 to rotate. The threaded shaft 30 threadably engaged with the threaded sleeve 29 is prevented from rotating because of the crushing plate 31 abutting the interior surfaces of the lower housing 14. This allows the threaded shaft 30 to move in an upward or downward direction within the threaded sleeve 29, which allows the crushing plate 31 to complete the crushing process. As described above, the appropriate reversing means is activated and the crushing plate 31 reverses direction. Finally, if the device is situated horizontally as shown in FIG. 8, the crushed container 42 then passes through and exits from the lower housing 14 through the second opening 41 and into a recycling bin just below.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A power operated container crushing device, the device comprising:

a crushing mechanism, an upper housing, wherein said upper housing includes means for retaining said crushing mechanism, means to power said crushing mechanism, and a switching mechanism functionally linked to said crushing mechanism;

a lower housing integral with said upper housing, wherein said lower housing includes a first opening for inserting the container therethrough and a door hingedly attached thereto for gaining or preventing access to said lower housing from said first opening, said lower housing further comprises a second opening to allow a crushed container to pass through and exit from said lower housing, said second opening positioned opposite from said first opening;

said crushing mechanism comprising a motor attached to and retained in said upper housing, a drive axle connected to a drive gear, an elongated threaded sleeve fixably attached to said drive axle for rotation thereof, said drive axle is inserted into one end of said threaded sleeve, wherein said motor includes a motor gear for rotational engagement with said drive gear; a threaded shaft for threadably engaging said threaded sleeve; and a crushing plate fixably attached to said threaded shaft;

a first support plate integral with said upper housing, said first support plate includes a first bore for said drive axle to pass through, a bearing integral with said first bore for rotational abutment to said drive axle;

a second support plate integral with said upper housing, said second support plate includes a second bore for said threaded sleeve to pass through;

wherein when said motor rotates said motor gear in one direction, said motor gear rotates said drive gear and said threaded sleeve, and said threaded shaft and said crushing plate move in a downward direction, in which said threaded shaft is not rotated within said threaded sleeve, thereby crushing any container inserted therein, and when said motor rotates in the opposite direction, said crushing plate moves in an upward direction.

2. The device of claim 1 wherein said door includes a latch mechanism whereby said switching mechanism is inoperable if said door is not fully latched.

3. The device of claim 2 wherein said door includes a denting means for predenting said container when said door is latched.

4. The device of claim 1 wherein said door includes a latch mechanism for closing said door and denting means for predenting said container when said door is latched.

5. The device of claim 1 wherein the crushing mechanism further comprises reversing means electronically coupled to said crushing mechanism for reversing the crushing plate from a downward direction to an upward direction.

6. The device of claim 5 wherein the reversing means is a pressure switch located on the crushing plate such that when said crushing plate extends to its lowest position, said switch is activated by coming in contact with the base of said lower housing thereby reversing said motor and the direction of said crushing plate.

7. The device of claim 5 wherein the reversing means is a torque sensor such that when a determined maximum torque is reached during the crushing of a container, the maximum torque is sensed by said sensor thereby reversing said motor and the direction of said crushing plate.

8. A power operated container crushing device, the device comprising:

a crushing mechanism, an upper housing, wherein said upper housing includes means for retaining said crushing mechanism, means to power said crushing mechanism, and a switching mechanism functionally linked to said crushing mechanism;

a lower housing integral with said upper housing, wherein said lower housing includes a first opening for inserting the container therethrough and a door hingedly attached thereto for gaining or preventing access to said lower housing from said first opening, wherein said door includes a latch mechanism for closing said door and denting means for predenting said container when said door is latched said lower housing further comprises a second opening to allow a crushed container to pass through and exit from said lower housing, said second opening positioned opposite from said first opening;

said crushing mechanism comprises a motor attached to and retained in said upper housing, a drive axle connected to a drive gear, an elongated sleeve is fixably attached to said drive axle for rotation thereof, said drive axle is inserted into one end of said threaded sleeve, wherein said motor includes a motor gear for rotational engagement with said drive gear; a threaded shaft for threadably engaging said threaded sleeve; and a crushing plate fixably attached to said threaded shaft;

a first support plate integral with said upper housing, said first support plate includes a first bore for said drive axle to pass through, a bearing integral with said first bore for rotational abutment to said drive axle;

a second support plate integral with said upper housing, said second support plate includes a second bore for said threaded sleeve to pass through;

wherein when said motor rotates said motor gear in one direction, said motor gear rotates said drive gear and said threaded sleeve, and said threaded shaft and said crushing plate move in a downward direction, in which said threaded shaft is not rotated within said threaded sleeve, thereby crushing any container inserted therein, and when said motor rotates in the opposite direction, said crushing plate moves in an upward direction;

wherein the crushing mechanism further comprises reversing means electronically coupled to said crushing mechanism for reversing the crushing plate from a downward direction to an upward direction.

9. The device of claim 8 wherein the reversing means is a pressure switch located on the crushing plate such that when said crushing plate extends to its lowest position, said switch is activated by coming in contact with the base of said lower housing thereby reversing said motor and the direction of said crushing plate.

10. The device of claim 8 wherein the reversing means is a torque sensor such that when a determined maximum torque is reached during the crushing of a container, the maximum torque is sensed by said sensor thereby reversing said motor and the direction of said crushing plate.

11. A power operated container crushing device, the device comprising:

a crushing mechanism, an upper housing, wherein said upper housing includes means for retaining said crushing mechanism, means to power said crushing mechanism, and a switching mechanism functionally linked to said crushing mechanism;

a lower housing integral with said upper housing, wherein said lower housing includes a first opening for inserting the container therethrough and a door hingedly attached thereto for gaining or preventing access to said lower housing from said first opening, wherein said door includes a latch mechanism for closing said door and denting means for predenting said container when said door is latched, and whereby said switching mechanism is inoperable if said door is not fully latched;

said crushing mechanism comprises a drive axle and a drive gear fixably attached to said drive axle for rotation thereof, an elongated threaded sleeve, and a motor attached to and retained in said upper housing, wherein said motor includes a motor gear for rotational engagement with said drive gear; wherein said elongated threaded sleeve is fixably attached to said drive axle for rotation thereof, said drive axle is inserted into one end of said threaded sleeve; a threaded shaft for threadably engaging said threaded sleeve; and a crushing plate fixably attached to said threaded shaft;

a first support plate integral with said upper housing, said first support plate includes a first bore for said drive axle to pass through, a bearing integral with said first bore for rotational abutment to said drive axle;

a second support plate integral with said upper housing, said second support plate includes a second bore for said threaded sleeve to pass through;

wherein when said motor rotates said motor gear in one direction, said crushing plate and said threaded shaft move in a downward direction into said lower housing, in which said threaded shaft is not rotated within said threaded sleeve, thereby crushing any container inserted therein, and when said motor rotates in the opposite direction, said crushing plate moves in an upward direction;

wherein the crushing mechanism further comprises reversing means electronically coupled to said crushing mechanism for reversing the crushing plate from a downward direction to an upward direction;

wherein said lower housing further comprises a second opening to allow a crushed container to pass through and exit form the lower housing, said second opening positioned opposite from said first opening.

12. The device of claim 11 wherein the reversing means is a pressure switch located on the crushing plate such that when said crushing plate extends to its lowest position, said switch is activated by coming into contact with the base of said lower housing thereby reversing said motor and the direction of said crushing plate.

13. The device of claim 11 wherein the reversing means is a torque sensor such that when a determined maximum torque is reached during the crushing of a container, the maximum torque is sensed by said sensor thereby reversing said motor and the direction of said crushing plate.

* * * * *